United States Patent [19]

Nigrelli

[11] Patent Number: 4,805,372

[45] Date of Patent: Feb. 21, 1989

[54] CONTOURED PACKAGE COVER DISPENSER

[75] Inventor: Nicholas B. Nigrelli, Cleveland, Wis.

[73] Assignee: Nigrelli Systems, Inc., Kiel, Wis.

[21] Appl. No.: 175,920

[22] Filed: Mar. 31, 1988

[51] Int. Cl.[4] ..... B65B 17/02; B65G 59/00

[52] U.S. Cl. ..... 53/48; 221/210

[58] Field of Search ..... 53/48; 221/211, 210, 221/213, 214, 216

[56] References Cited

U.S. PATENT DOCUMENTS 3,618,792 11/1971 Paxton ..... 221/214 X 4,392,586 7/1983 Hartness et al. ..... 53/48 X 4,545,173 10/1985 Hartness et al. ..... 53/48

*Primary Examiner*—Willie G. Abercrombie

*Attorney, Agent, or Firm*—Ronald E. Barry

[57] ABSTRACT

A bottle packaging apparatus including a dual line bottle conveyor, a cover conveyor for feeding contoured covers to the bottles on the conveyor, a magazine positioned above the cover conveyor and including a pair of guide tubes for supporting a stack of contoured covers, each cover including flexible means for separating one cover from another, and a tab or ring mounted on the bottom of the guide tube for bending the flexible means into engagement with the next cover to physically separate the cover from the stack when the cover is pulled off of the guide tubes.

14 Claims, 3 Drawing Sheets

34
28
40
34
40
34
36
46
36
32
38
35
35
34
38
34
30

16
40
46
40
44
40
46
42
40
20
5
46
46
5
20
14
55
50
58
48
57
56
22
59
52
56
54
53

CONTOURED PACKAGE COVER DISPENSER

BACKGROUND OF THE INVENTION

1. Field of the Invention

This invention pertains to apparatus for packaging groups of bottles by mounting a plastic contoured cover on the neck of the bottles and, more particularly, to apparatus for separating each of the contoured plastic covers from the bottom contoured cover in a stack of contoured covers.

2. Description of the Prior Art

Contoured covers of the type contemplated herein are made of a flexible plastic material and are provided with a number of openings corresponding to the number of bottles to be grouped in each package. The covers are stacked in groups of one hundred or more in a magazine. Due to the nature of the material of the contoured cover and its configuration, it is difficult to separate each cover from the bottom of the stack for automatic placement on the bottles. The covers are removed one at a time from the bottom of the stack by a vacuum system. The vacuum system includes a nozzle having a cup on the end that is moved into engagement with the bottom of a contoured cover. The nozzle is moved downward to pull the cover downward from the stack and deposit the cover on a conveyor for transport to a position for automatic pick up by each group of bottles. When operating at high speed the vacuum nozzle will often pull two or more covers off of the stack. Since it is not practical to stop the machine each time this occurs, the packaging machine will automatically seat the covers on the bottles regardless of the number of covers. If this continues to occur, then the machine must be stopped to correct the problem. This obviously increases the cost due to the slow down in production or the cost of the extra covers if mounted on the bottles.

SUMMARY OF THE INVENTION

The present invention provides a simple, inexpensive and reliable means for automatically separating each contoured cover from the bottom of a stack of covers in a magazine. The magazine generally includes a pair of guide tubes of a semi-circular configuration which are mounted in a parallel spaced relation. The covers are provided with semi-circular grooves which correspond to the shape of the semi-circular tubes. The covers are stacked on the guide tubes by inserting the tubes through the grooves in the covers.

One of the principal features of the invention is the provision of a stripper tab at the bottom of each of the guide tubes which is positioned to engage a release tab or flap formed in the top of the cover by each of the semi-circular grooves. The stripper tab is used to provide both a support for the covers stacked on the guide tubes as well as a stop in the path of motion of the flaps on the cover. As the bottom cover in the stack is pulled off the guide tubes, the stripper tab will force the flap upward to physically separate the cover on the bottom of the stack from the next cover on the stack as the cover is pulled off the guide tubes.

Other principal features and advantages of the invention will become apparent to those skilled in the art upon review of the following detailed description claims and drawings.

Figure 1:
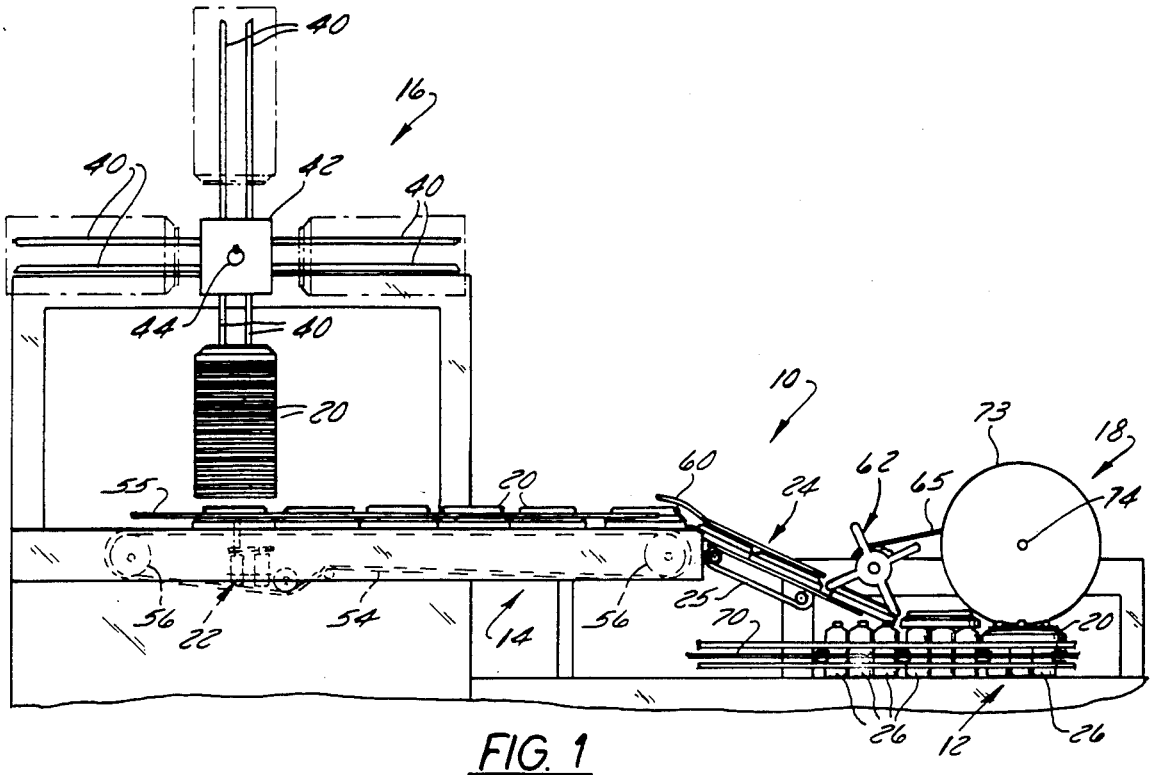
FIG. 1 is a side elevation view showing the contoured cover magazine positioned over the bottle conveyer for a bottle packaging machine.

Before one embodiment of the invention is explained in detail, it is to be understood that the invention is not limited in its application to the details of construction and the arrangements of components set forth in the following description or illustrated in the drawings. The invention is capable of other embodiments and of being practices or being carried out in various ways. Also, it is to be understood that the phraseology and terminology used herein is for the purpose of description and should not be regarded as limiting.

DESCRIPTION OF THE INVENTION

Figure 3:
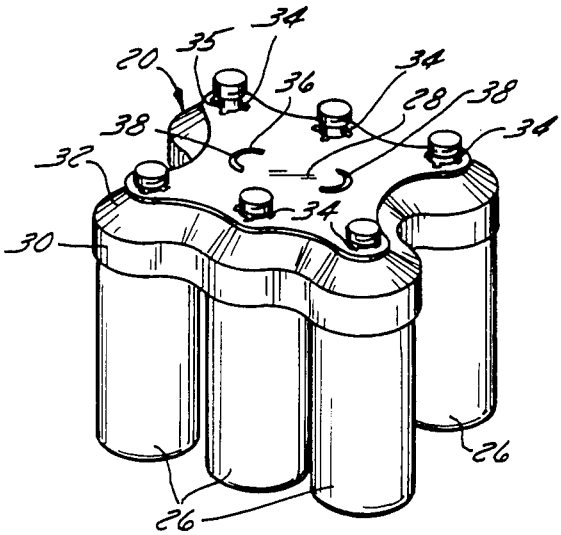
FIG. 3 is a perspective view of the six pack package with the contoured cover mounted on the bottles.

The contoured cover packaging apparatus 10 generally includes a double line bottle conveyor assembly 12, a contoured cover conveyor assembly 14, a contoured cover storage magazine 16, an inclined cover conveyor timing assembly 24, and a cover setting assembly 18. The contoured covers 20 are removed from the magazine 16 and deposited on the cover conveyor assembly 14 by means of a vacuum system 22. The covers 20 are carried to the inclined conveyor timing assembly 24 for automatic placement on the top of the groups of bottles 26. The bottles 26 are conveyed to the timing assembly 24 by means of the conveyor assembly 12 which separates the bottles into groups of six as they approach the inclined conveyor 24. Each group of bottles 26 is moved into engagement with the inside of the front edge 21 of the cover 20 at the bottom of conveyor assembly 24. The cover is removed from the inclined conveyor assembly 24 by the motion of the group of bottles. Each group of six bottles 26 is then moved through the cover setting assembly 18 where the cover 20 is pushed down onto the neck of the bottles 26 to form a six pack as shown in FIG. 3.

Figure 2:
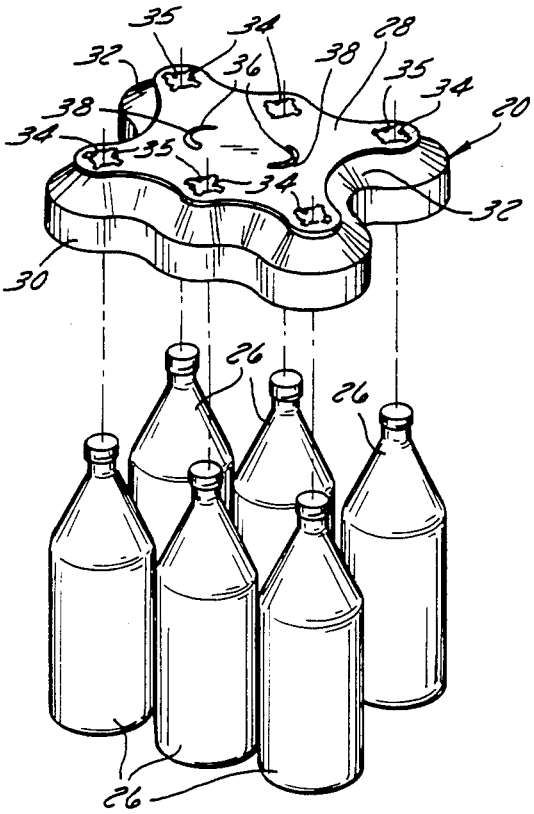
FIG. 2 is a perspective view of one of the contoured covers shown positioned over a group of six bottles.
Figures 4, 5:
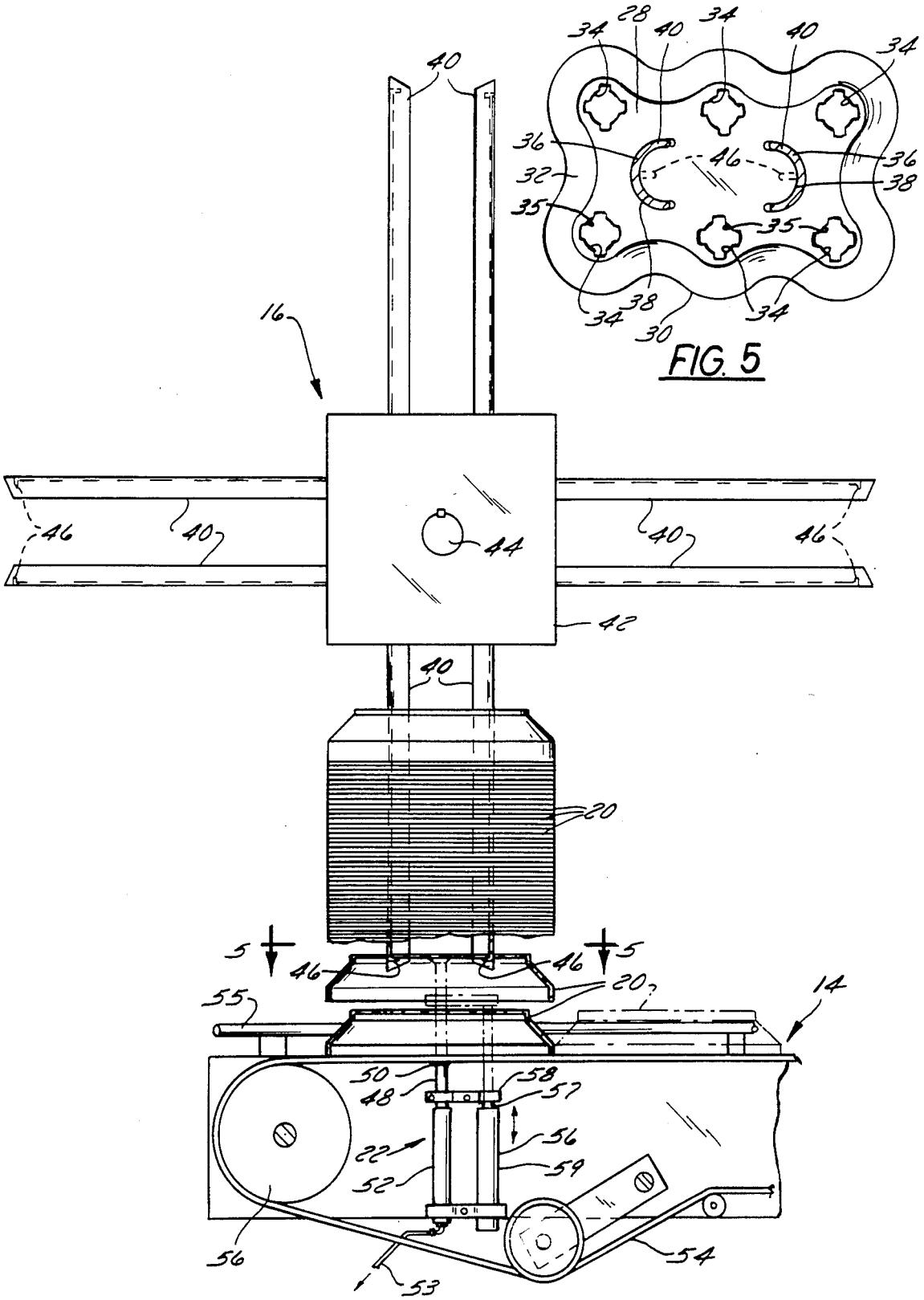
FIG. 4 is a side elevational view of the contoured cover magazine shown partly in section and located above the cover conveyor with the vacuum nozzle in the down position.
FIG. 5 is a view taken on line 5—5 of FIG. 4 showing the top of the contoured cover.

The contoured covers 20 of the type contemplated herein are formed from a semi-rigid plastic material as shown in FIGS. 2 and 5. Each cover 20 includes a flat top 28 and contoured side walls 30 which are connected to the flat top 28 by an inclined or sloped wall 32. As seen in FIGS. 2 and 3, the side walls 30 are contoured to the shape of the outer surface of the sides of the bottles 26 so that the cover 20 is centered on the group of bottles when dropped onto the bottles 20. The top 28 is provided with six openings 34 which correspond to the position of the tops in a group of six bottles 26. Each of the holes 34 is provided with four tabs 35 which are used to lock the cover onto the neck of the bottles. A pair of semi-circular grooves or slots 36 are provided in the center of the top 28 of the cover which forms a pair of semi-circular release flaps 38.

CONTOURED COVER MAGAZINE

The contoured covers 20 are supported in stacks of 100 to 150 covers on the magazine 16. The magazine includes four pairs of semi-circular guide tubes 40 which are mounted in a parallel spaced relation on a hub 42. The hub 42 is mounted for rotary motion on a shaft 44. Each of the guide tubes 40 is in the form of a semi-circle identical to the semi-circular slots 36 provided in the cover 20. As seen in FIG. 4, the guide tubes 40 are arranged so that the open side of the semicircles are facing each other.

Figure 6:
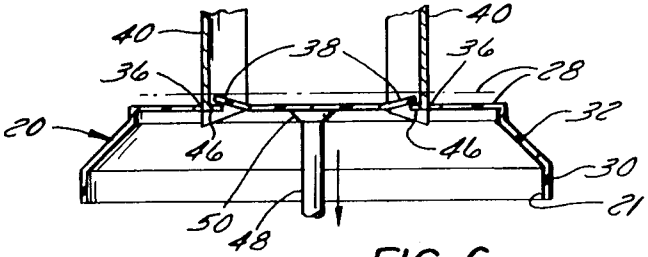
FIG. 6 is an enlarged view in cross section showing the release tab bent up by the stripper tabs on the end of the semi-circular guide tubes.
Figure 7:
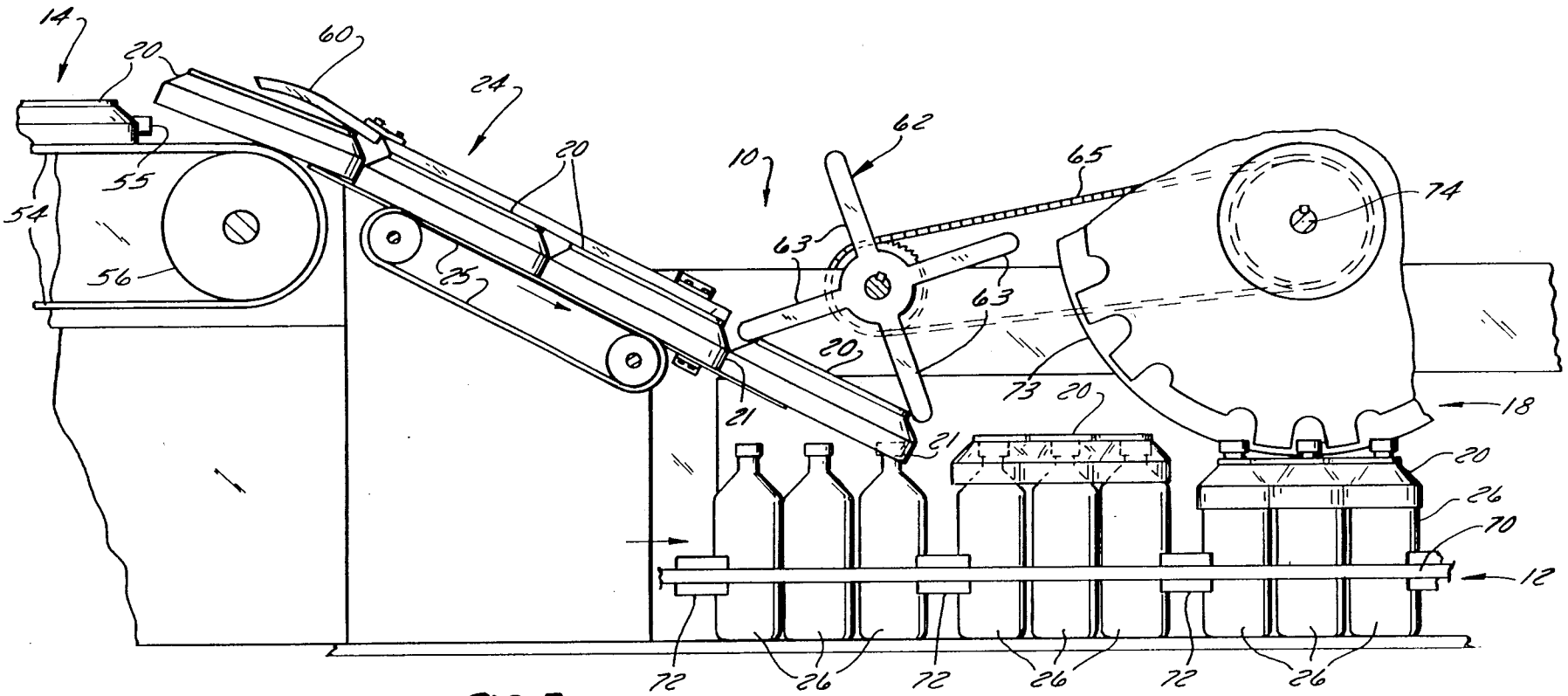
FIG. 7 is a side elevational view showing the contoured cover conveyor feeding covers to the bottles on the bottle conveyor.

A stack of covers 20 is mounted on a pair of guide tubes 40 by aligning the slots 36 with the ends of the tubes 40 and pushing the stack onto the tubes. The covers are retained thereon by means of stripper tabs 46 which are provided at the outer ends of each of the guide tubes 40. The stripper tabs 46 are also used to bend the release flaps 38 in the cover 20 into engagement when the next cover in the stack as the cover is removed from the stack. As seen in FIG. 6, as the bottom cover is pulled down, the flaps 38 will be forced upward into engagement with the bottom of the next cover in the stack to physically separate the bottom cover from the next cover in the stack as the bottom cover is pulled from the stack.

Figure 8:
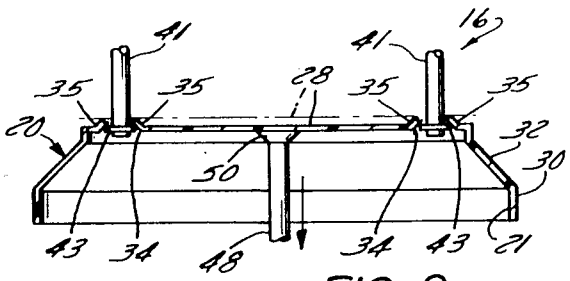
FIG. 8 is an enlarged view in section showing round guide tubes supporting the contoured cover.

In the alternate embodiment shown in FIG. 8, the guide tubes are shown as round rods 41 which are aligned with the bottle top holes 34 in each side of cover 20. Each of the holes 34 is provided with four tabs 35 as described above. The tabs 35 can be used to separate the covers 20 by means of a ring 43 mounted on the bottom of each rod 41. On movement of cover 20 from the end of the rods 41, the ring 43 will bend the tabs 35 upward to physically separate the cover 20 from the stack.

VACUUM NOZZLE APPARATUS

The covers 20 are removed from the cover stack by means of the vacuum system 22 which is located below the cover conveyor assembly 14. Referring to FIG. 4, the vacuum system 22 includes a vacuum nozzle 48 having a vacuum cup 50 at the upper end. The vacuum nozzle 48 is mounted for reciprocal motion in a vacuum tube 52 which is connected to a vacuum pump (not shown) by a line 53. It should be noted that nozzle 48 is moved into engagement with the inside of the cover 20 by means of a pneumatic lift mechanism 56. The lift mechanism 56 includes a piston 57 which is connected to the nozzle 48 by means of a plate 58. The piston 57 is mounted for reciprocal motion in a cylinder 59 and is raised to move the vacuum nozzle 48 toward the stack of covers until the cup 50 engages the bottom of cover 20. Although a pneumatic lift mechanism 56 has been shown and described, it should be noted that a cam assembly can also be used to reciprocate the vacuum nozzle into engagement with the covers for removal to the cover conveyor.

Referring to FIG. 6 an enlarged cross sectional view of one of the pair of guide tubes 40 is shown with the bottom cover 20 pulled downward slightly from the stack. It should be noted that the stripper tab 46 has bent the release flap 38 upward against the bottom of the next cover in the stack. The downward movement of the cover forces the release flap 38 upward into engagement with the next cover 20 in the stack causing a positive physical separation of the cover 20 from the stack. This assures that only one cover 20 will be released from the guide tubes 40 each time the vacuum nozzle 48 pulls a cover off of the guide tubes. The vacuum nozzle 48 is moved into the vacuum tube 52 far enough for the cup 50 to clear the bottom of the cover 20 for pick up by the conveyor assembly 14.

THE COVER CONVEYOR

The covers 20 are deposited on the cover conveyor assembly 14 for movement towards the inclined conveyor 24. The conveyor assembly 14 includes a pair of belts 54 mounted on pulleys 56 and a pair of guides 55 provided on each side of the conveyor belts 54 to align the covers on the conveyor. As a cover 20 is moved away from the stack a sensor provided on the conveyor assembly is used to signal the vacuum nozzle system to remove another cover from the stack. As the covers move toward the inclined ramp 24, they are tipped by means of a guide 60 which is positioned to engage the front edge of the top of the cover so that it will tip to the same angle as the inclined conveyor 24.

The convers 20 are driven down the inclined ramp 24 by means of a conveyor belt 25 into engagement with a star wheel 62 which is positioned to engage the front edge 21 of the cover 20 at the bottom of the ramp 24. It should be noted that the front edge of the cover 20 is stopped in the path of travel of the top of the bottles 26 on conveyor assembly 12. The star wheel 62 includes four arms 63 which are rotated into the point of travel of the front edge of the cover. The star wheel 62 is driven by means of a drive chain 65 connected to the cover setting apparatus 18 so that a cover 20 is released as the two bottles 26 in the front of each group of bottles moves into engagement with the inside of the front edge 21 of the cover to allow the bottles to pull the cover away from the ramp 24. The star wheel 62 is rotated as soon as the cover 20 starts to move off of the ramp so that the next arm 63 moves into the path of motion of the next cover 20 on the ramp 24.

The bottles 26 are conveyed to a conventional double line conveyor assembly 12 which includes a conveyor belt 70 on each side of the line of bottles. Groupers 72 are mounted on each belt 70 at intervals equal to three bottles 26 to form each group of six bottles.

As each group of bottles 26 moves from the inclined ramp to the cover setting apparatus 18, the covers 20 are pushed down onto the necks of the bottles 26. The cover setting apparatus includes a pair of wheels 73 mounted on a shaft 74 which are used to seat the covers on the necks of the bottles.

Thus it is apparent that there has been provided, in accordance with the invention, a contoured cover dispenser and setting apparatus that fully satisfies the objects and advantages set forth above. While the invention has been described in conjunction with specific embodiments thereof, it is evident that many alternatives, modifications, and variations will be apparent to those skilled in the art. Accordingly, it is intended to embody all such alternatives, modifications and variations as fall within the spirit and broad scope of the appended claims.

The embodiments of the invention in which an exclusive property or privilege is claimed are defined as follows:

1. A bottle packaging apparatus comprising;

a dual line bottle conveyor for conveying bottles in groups of six;

a cover conveyor including an inclined ramp for feeding contoured covers to a position with the front edge of the cover in the path of travel of the tops of the bottles;

a magazine positioned above said cover conveyor and including a pair of guide tubes for supporting a stack of contoured covers, each cover including flexible means for separating the bottom cover from the next cover in the stack; and means mounted at the bottom of each of said tubes for bending said flexible means into engagement with the next cover in the stack as the cover is pulled downward to separate the bottom cover from the stack.

2. The apparatus according to claim 1 wherein each of said guide tubes has a semi-circular configuration and said flexible means comprises a pair of semi-circular flaps conforming to the shape of said guide tubes.

3. The apparatus according to claim 1 or 2 wherein said bending means comprises a tab at the end of each guide tube.

4. The apparatus according to claim 1 wherein said covers include a number of openings corresponding to the location of the bottles in each group, said flexible means comprising a number of flexible tabs around each opening for securing the cover on said bottles and said guide tubes being positioned to engage two of said holes.

5. The apparatus according to claim 4 wherein said guide tubes are shaped to correspond to said openings and said bending means comprises a ring.

6. A bottle packaging machine for transferring contoured covers from a magazine to the top of a group of bottles, said magazine including a pair of guide tubes;

each of said covers including a pair of openings corresponding to the configuration of said guide tubes;

each of said openings including a flexible release means;

each of said guide tubes including a stripper means at the end of each tube in a position to engage said release means; and means for pulling covers from said stack whereby said stripper means will bend said release means into engagement with the next cover in the stack as the bottom cover is pulled from the guide tube.

7. The machine according to claim 6 wherein each of said guide tubes has a semicircular configuration and said openings conform to the configuration of said guide tubes.

8. The machine according to claim 7 wherein said guide tubes are mounted in a parallel spaced relation with the open sides of said guide tubes facing each other.

9. The machine according to claim 6 wherein said guide tubes are round and said openings conform to the configuration of said guide tubes.

10. The machine according to claim 9 wherein said stripper means comprises a ring mounted at the bottom of each of said guide tubes and said release means comprise a number of tabs around the inside of each of said openings.

11. In a contoured cover packaging apparatus for mounting contoured covers on the necks of groups of bottles, the contoured covers being of the type having a flat top with openings corresponding to the number of bottles in each group and a pair of semi-circular openings in the top of the cover forming release flaps, said apparatus comprising a dual line bottle conveyor for transporting bottles in groups;

a contoured cover conveyor disposed above said bottle conveyor for transporting covers to said bottle conveyor;

a magazine disposed above said cover conveyor for supporting a stack of covers;

said magazine including a pair of semi-circular guide tubes corresponding to said semi-circular openings in said covers whereby said covers can be stacked on said tubes; and vacuum means disposed below said cover conveyor for transferring covers from said magazine to said cover conveyor, the improvement comprising stripper means at the end of each guide tube for engaging said release flaps in each cover whereby said flaps are bent into engagement with the bottom of the next cover in the stack when a cover is pulled off of said guide tubes to physically separate a cover from the next cover in the stack.

12. The apparatus according to claim 11 wherein said stripper means comprises a tab on each guide tube located in the path of motion of said release flaps in the top of the cover.

13. In a contoured cover packaging apparatus for mounting contoured covers on the necks of groups of bottles, the contoured covers being of the type having a flat top with openings corresponding to the number of bottles in each group in the top of the cover, a number of tabs around each opening, said apparatus comprising a dual line bottle conveyor for transporting bottles in groups;

a contoured cover conveyor disposed above said bottle conveyor for transporting covers to said bottle conveyor;

a magazine disposed above said cover conveyor for supporting a stack of covers;

said magazine including a pair of round guide tubes corresponding to said openings in said covers whereby said covers can be stacked on said tubes; and vacuum means disposed below said cover conveyor for transferring covers from said magazine to said cover conveyor, the improvement comprising stripper means at the end of each guide tube for engaging said tabs in each opening whereby said tabs are bent into engagement with the bottom of the next cover in the stack when a cover is pulled off of said guide tubes to physically separate a cover from the next cover in the stack.

14. The apparatus according to claim 13 wherein said stripper means comprises a ring on each guide tube located in the path of motion of said tabs in the openings in the top of the cover.

* * * * *